US007735334B2

(12) United States Patent
Johnson

(10) Patent No.: US 7,735,334 B2
(45) Date of Patent: Jun. 15, 2010

(54) PORTABLE COOLER

(76) Inventor: Mark Johnson, 33 Broadway, Chula Vista, CA (US) 91915

( * ) Notice: Subject to any disclaimer, the term of this patent is extended or adjusted under 35 U.S.C. 154(b) by 40 days.

(21) Appl. No.: 11/773,333

(22) Filed: Jul. 3, 2007

(65) Prior Publication Data

US 2008/0006051 A1 Jan. 10, 2008

Related U.S. Application Data

(60) Provisional application No. 60/818,518, filed on Jul. 6, 2006.

(51) Int. Cl.
*F25D 3/08* (2006.01)

(52) U.S. Cl. ..... 62/457.4; 62/457.9

(58) Field of Classification Search ..... 62/457.1, 62/457.4, 457.9

See application file for complete search history.

(56) References Cited

U.S. PATENT DOCUMENTS

| | | | | |
|---|---|---|---|---|
| 2,571,674 | A * | 10/1951 | Braunstein | 63/15 |
| 2,917,906 | A | 12/1959 | Wooley | |
| 3,254,502 | A * | 6/1966 | Stafford | 62/257 |
| 4,006,606 | A * | 2/1977 | Underdue | 62/449 |
| 4,164,853 | A | 8/1979 | McDonough | |
| 4,225,059 | A * | 9/1980 | Kappos | 222/146.6 |
| 4,633,678 | A | 1/1987 | Lea et al. | |
| 4,724,681 | A | 2/1988 | Bartholomew et al. | |
| 4,914,920 | A * | 4/1990 | Carnagie et al. | 62/3.3 |
| 5,249,468 | A | 10/1993 | Rhaney et al. | |
| 5,313,817 | A | 5/1994 | Meinders | |
| 5,339,986 | A * | 8/1994 | Mihalich | 222/1 |
| 5,683,097 | A | 11/1997 | Fenton et al. | |
| 6,205,794 | B1 * | 3/2001 | Brothers | 62/51.1 |
| 6,336,341 | B1 * | 1/2002 | McGraw et al. | 62/420 |
| 6,386,557 | B1 | 5/2002 | Weldon | |
| 6,481,238 | B1 * | 11/2002 | Jennings et al. | 62/457.4 |
| D469,787 | S | 2/2003 | Wicker | |

(Continued)

FOREIGN PATENT DOCUMENTS

DE 197 20 533 A1 11/1998

(Continued)

OTHER PUBLICATIONS

"The Sudsbuddy Cooler," viewed at www.beercooler.com on Jun. 13, 2002, 2 pages.

(Continued)

*Primary Examiner*—Melvin Jones
(74) *Attorney, Agent, or Firm*—John K. Buche; Buche & Associates, P.C.

(57) ABSTRACT

The portable cooler is a portable refrigeration system for selectively and adjustably cooling a removable container, such as a beer keg, for example. The portable cooler includes a housing that defines an open interior region for removably receiving the keg. A door is pivotally mounted to the housing, providing the user with selective access to the open interior region. A refrigeration device is mounted within the housing, adjacent the container, and may be powered by an external power supply or by rechargeable batteries, also received within the housing. Wheels are pivotally mounted to a lower end of the housing, and a handle is mounted to an upper end of the housing, allowing the user to selectively transport the housing and keg.

24 Claims, 7 Drawing Sheets

U.S. PATENT DOCUMENTS

| | | | | |
|---|---|---|---|---|
| 6,520,514 | B2 | 2/2003 | Clegg | |
| 6,595,016 | B1 * | 7/2003 | Demirkiran | 62/236 |
| 6,855,880 | B2 | 2/2005 | Feher | |

FOREIGN PATENT DOCUMENTS

| | | | |
|---|---|---|---|
| DE | 100 30 547 | A1 | 1/2002 |
| GB | 2 245 054 | A | 12/1991 |

OTHER PUBLICATIONS

"Draft Beer Cooler/Dispenser," viewed at www.bigtray.com/productsdetails.asp!shu.TRUTDD1.catid.10311.html, on Jun. 13, 2002, 2 pages.

"16" Rolling Cooler—Yellow," viewed at www.target.com on Jun. 13, 2002, 2 pages.

"24" Beer Keg Cooler with Stainless Steel Reversibile Door & Auto Cycle Defrost," viewed at www.ajmadison.com/cgi-bin/ajmadison/DKC645BLS.html on Jun. 13, 2002, 3 pages.

* cited by examiner

PORTABLE COOLER

RELATED APPLICATIONS

This application claims the benefit of priority to U.S. provisional application No. 60/818,518, filed Jul. 6, 2006, the contents of which is incorporated herein by reference in its entirety.

BACKGROUND OF THE INVENTION

1. Field of the Invention

The present invention relates to a portable cooler, which is a portable refrigeration system for selectively and adjustably cooling and transporting a removable container, such as a beer keg, for example.

2. Background

Large beverage containers, such as beer kegs and the like, require either large-scale or specially adapted refrigeration units. Such units are typically mounted within bars or restaurants, such that the container may be placed in the refrigeration unit and tapped to dispense the cooled beverage to the patrons. Such refrigeration units, however, are typically permanently mounted within the bar or counter of the bar or restaurant, thus allowing for efficient cooling of the beverage to take place only in the bar or restaurant.

Users may desire to cool a beverage container, such as the exemplary beer keg, in a remote location, and not a bar, restaurant or other food and drink service establishment. Though a beer keg or the like may be mounted on a dolly or other transportation device to transport the keg to the remote location, the specialized refrigeration unit cannot be transported along with the container because it is heavy and difficult to maneuver.

SUMMARY OF THE INVENTION

The portable cooler is a portable refrigeration system for selectively and adjustably cooling a removable container, such as a beer keg or a carbonated beverage system, for example. The portable cooler includes a housing, which defines an open interior region therein for removably receiving the container. The housing can be made of any suitable material, including plastic, steel, aluminum or the like, and may be insulated to prevent refrigeration loss from or heat transfer into the interior region. An opening is formed through a front face of the housing, and a door or pair of doors is pivotally mounted to the housing, providing the user with selective access to the open interior region. The door or doors selectively covers and seals the opening formed through the front face of the housing, and may include latches or the like, for selectively and releasably locking the door to the housing. Further, a door handle may be mounted to the door, providing the user with a gripping device for easily opening and closing the door. In one embodiment, the housing includes an open upper portion, allowing the keg, or other container, to project upwardly therethrough.

A refrigeration device is mounted within the housing, adjacent the container, and may be powered by an external power supply or by rechargeable batteries, also received within the housing. In certain embodiments, the cooler includes means for is electrically connecting the refrigeration device to a motor vehicle cigarette lighter. In other embodiments, the refrigeration device can be electrically connected through a suitable means to a solar power unit which may contain a solar cell or photovoltaic panel and a power storage block.

In one aspect of the invention, the refrigeration device is a compact unit scaled to cool the beverage container. The refrigeration device may include refrigeration coils, a compressor and other conventional refrigeration elements. A control panel may be mounted on the housing, with the control panel being in communication with the refrigeration device, allowing the user to selectively and adjustably control the temperature within the housing.

A plurality of wheels are pivotally mounted to a lower end of the housing, and a handle is mounted to an upper end of the housing, allowing the user to selectively transport the housing and container in a controlled manner. The handle is preferably retractable within the housing. In certain embodiments, a second, optionally retractable handle is mounted to a lower end of the housing to facilitate lifting the portable cooler using two hands or by two persons. In one aspect of the invention, the first and second handles are mounted to the rear of the housing. Further, a support stand may be pivotally mounted to a rear face of the housing, allowing the housing to be supported at an angle with respect to a support surface, such as the floor or the ground.

These and other features of the present invention will become readily apparent upon further review of the following specification and drawings.

BRIEF DESCRIPTION OF THE DRAWINGS

FIG. 7A is a front view of the alternative embodiment the portable cooler. FIG. 7B is a top view of the portable cooler viewed from the front. FIG. 7C is a side view of the alternative embodiment the portable cooler. FIG. 7D is a rear view of the alternative embodiment the portable cooler.

Similar reference characters denote corresponding features consistently throughout the attached drawings.

DETAILED DESCRIPTION OF THE INVENTION

Figure 1:
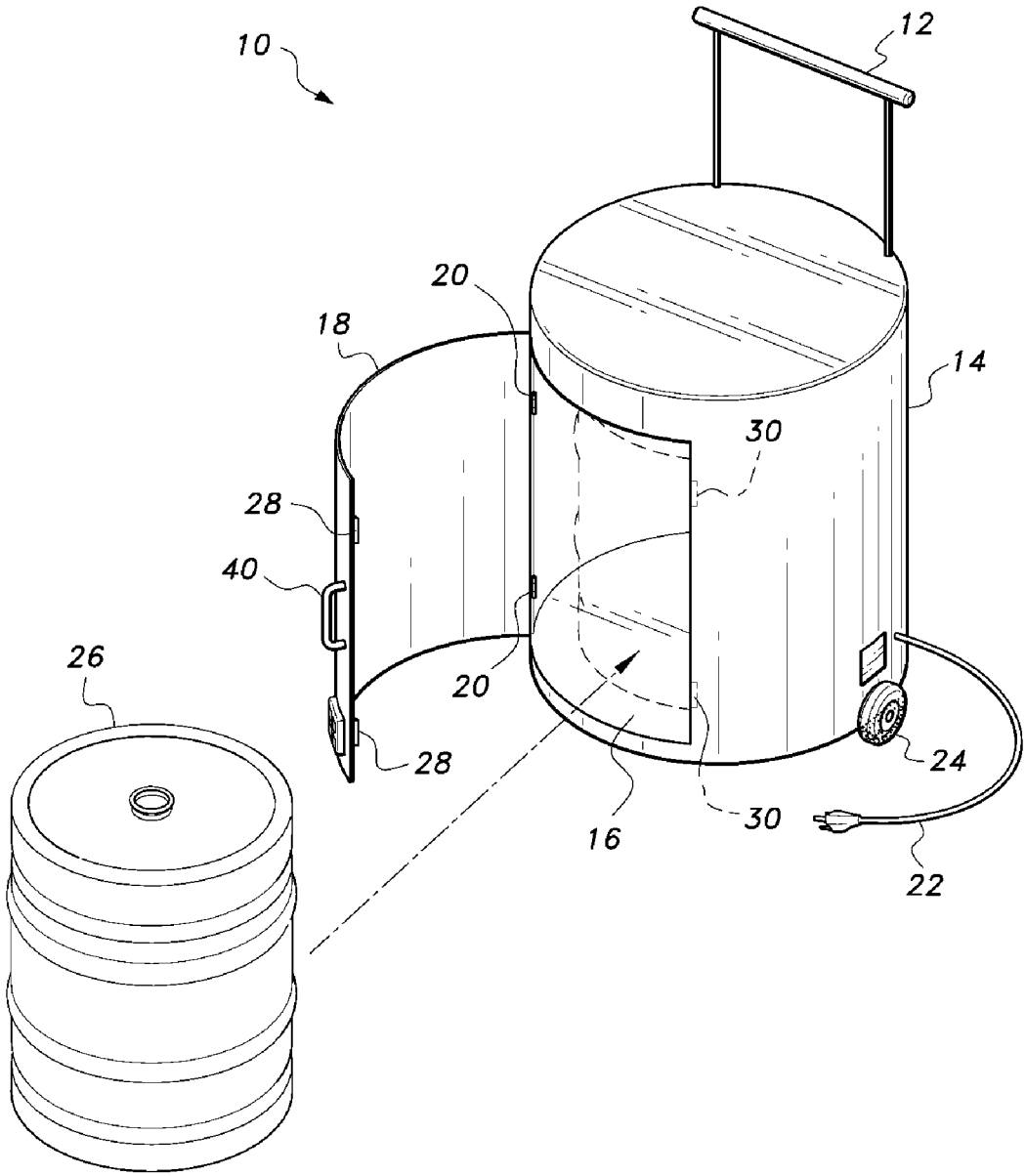
FIG. 1 is an environmental, perspective view of a portable cooler according to the present invention.
Figure 6:
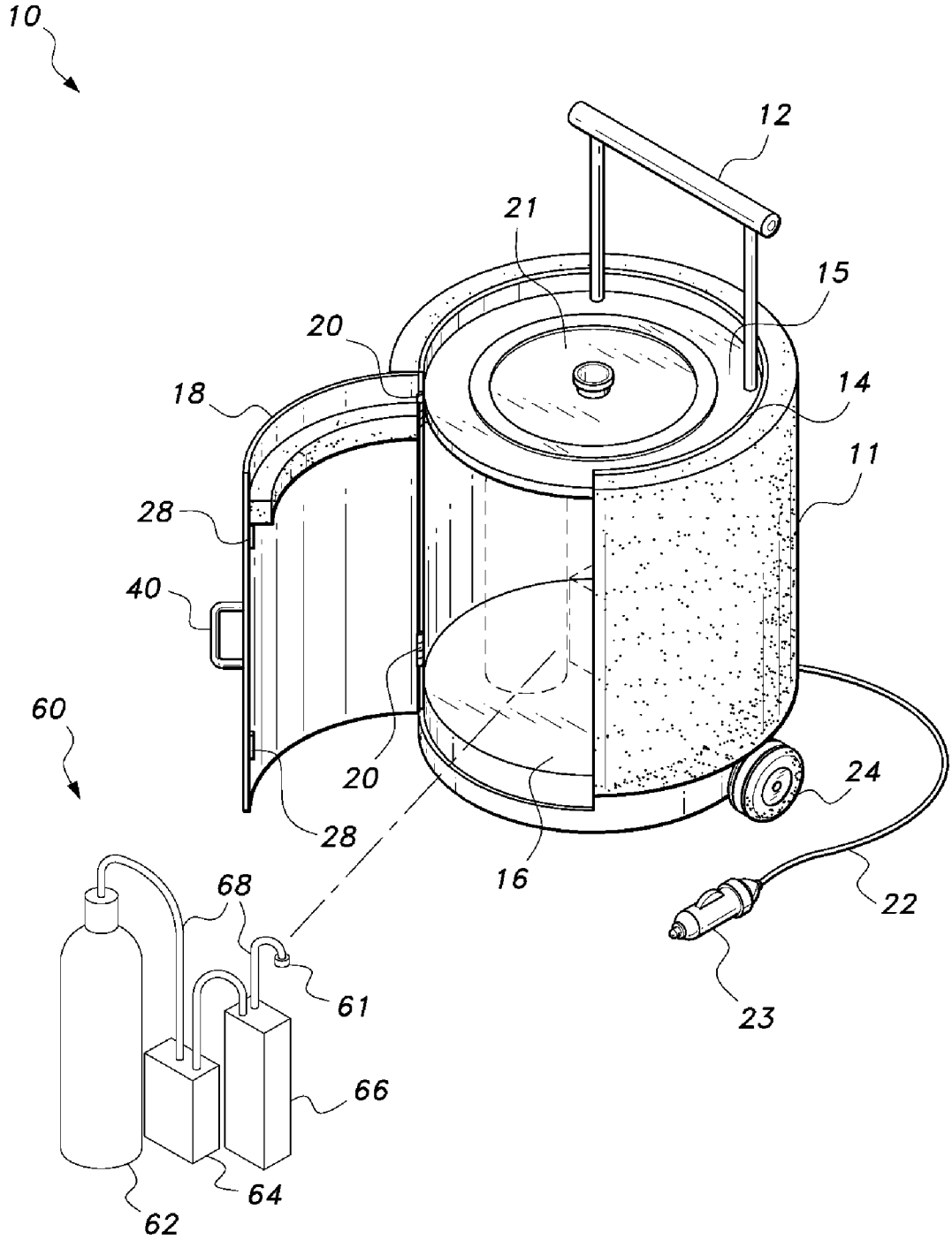
FIG. 6 is an environmental, perspective view of an alternative embodiment of the portable cooler according to the present invention.
Figures 7A, 7B, 7C, 7D:
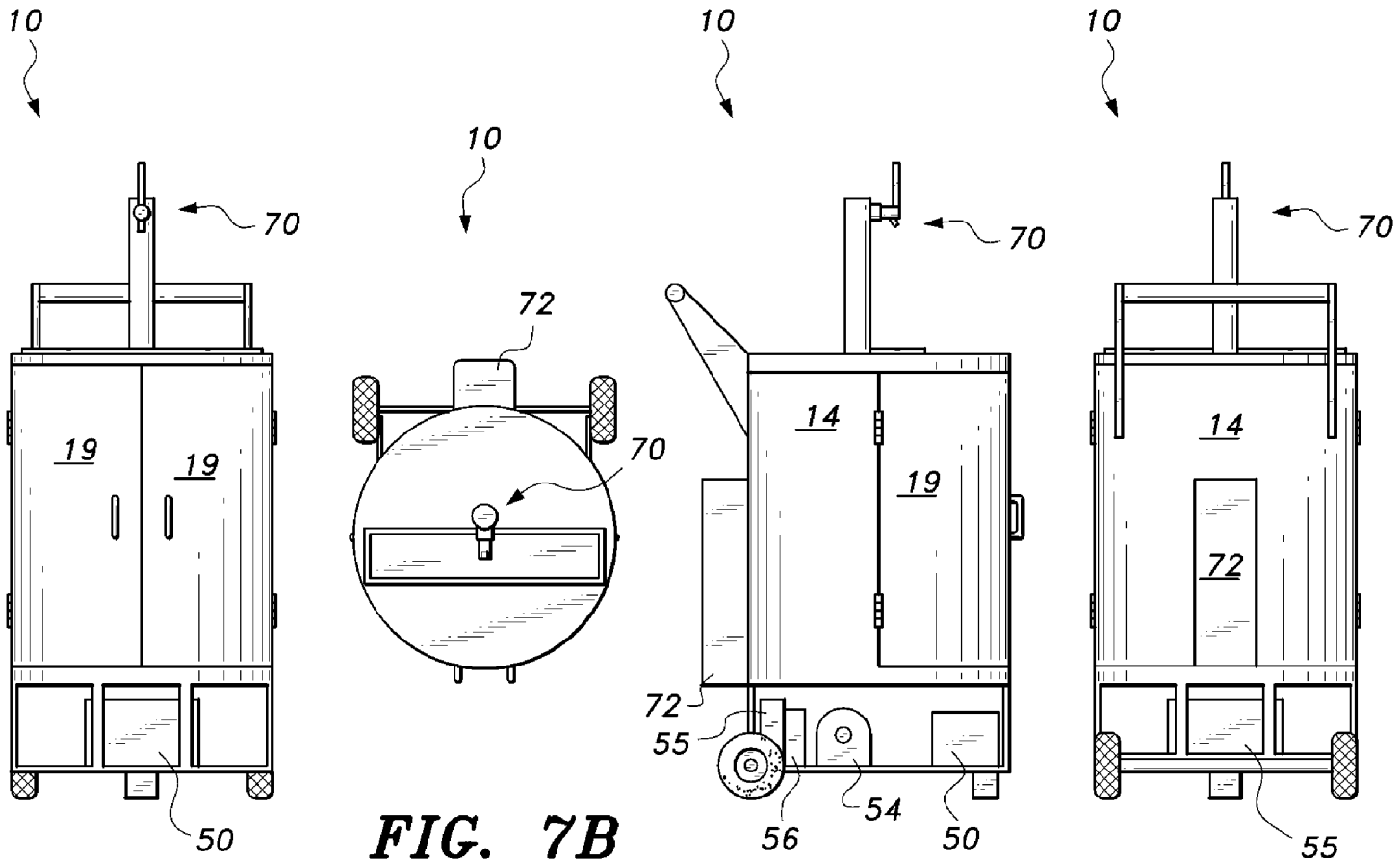
FIGS. 7A-7D show various views of an alternative embodiment a portable cooler according to the present invention.

The present invention is a portable cooler 10. The portable cooler 10 is a portable refrigeration system for selectively and adjustably cooling a removable container, such as a beer keg, for example. It should be understood that the portable cooler 10 may be utilized for the cooling and transportation of any container received therein, and that the beer keg 26, illustrated in FIG. 1, and the carbonated beverage system illustrated in FIG. 6 are for exemplary purposes only. Further, the portable cooler 10 may be sized, contoured and constructed from materials dependent upon the needs and desires of the user, and further dependent upon the size, contour and nature of container being stored and transported within cooler 10.

As shown in FIGS. 1-7, the portable cooler 10 includes a housing 14 that defines an open interior region 16 therein, for removably receiving the keg 26, carbonated beverage system 60, or any other suitable container. In one embodiment, housing 14 has a substantially cylindrical contour, however, as described above, housing 14 may be sized, contoured and constructed from suitable materials dependent upon the needs and desires of the user.

In one aspect of the invention, housing 14 is constructed from steel, particularly stainless steel. In another aspect of the invention, housing 14 is constructed from aluminium, any other suitable metal, mixtures or alloys thereof. The metal may be anodized, galvanized, coated or treated in a manner suitable to protect the surfaces thereof. In certain embodiments, housing 14 may have a single wall construction. In other embodiments, double or triple wall construction may be used.

As illustrated in FIG. 6, the invention further contemplates that housing 14 may be insulated, such as by wrapping, coating or encasing it in an insulating material 11, as shown in FIG. 6. The insulating material can be any material suitable for preventing heat transfer to the housing and/or preventing refrigeration loss. Suitable insulating materials according to the present invention include but are not limited to urethanes, polystyrenes, polyesters, epoxies, and natural or synthetic rubbers, which may for example, be foamed, expanded or extruded.

In certain embodiments, housing 14 comprises plastic. The entire housing 14 may be made of plastic or similar material, for example in a molded, extruded or fabricated form. In other embodiments, housing 14 may comprise multiple layers, such as an inner layer of steel or other metal, with or without an insulating layer, which is encased or coated in plastic, rubber or other resilient material. According to certain non-limiting aspects of this embodiment, the coating may serve the purpose of protecting or enclosing the inner and/or insulating layers. In other aspects the coating can be decorative and/or provide a surface on which brand information and/or instructions can be applied. Furthermore, the outer layer, where used, may be textured to provide slip resistance to facilitate handling.

As shown, the housing 14 may have an open upper portion, allowing the keg 26 or other container to project upwardly therethrough when the keg 26 is received within the housing 14. Alternatively, housing 14 may include a closed upper portion 21, allowing for complete coverage of the keg 26. The contouring and configuration of the housing 14 are dependent upon the needs and desires of the user. This skilled artisan will appreciate that the size of any opening in housing 14 may be adapted as required to accommodate the keg 26, carbonated beverage system 60, other container or any fittings thereon. In certain aspects of the invention, the housing may be fitted with a tap 70 as illustrated in FIGS. 7A-7D, nozzle, dispensing gun or other device for connecting to the keg 26, carbonated beverage system 70 or other container to conveniently dispense a beverage contained therein.

An opening is formed through a front face of the housing 14, providing access to the open interior region 16, and a door 18 is pivotally mounted to the housing 14. Door 18 is preferably secured to housing 14 by hinges 20, or by any other suitable means for pivotal attachment. Door 18 provides the user with selective access to the open interior region 16. The door 18 selectively covers and seals the opening formed through the front face of the housing 14, and may include latches 28 or the like, for selectively and releasably locking the door 18 to the housing 14. In certain embodiments, a set of double doors 19 may be used in place of a single door, each independently hinged and independently operable. The invention contemplates that double doors may allow partial access to the keg 26, carbonated beverage system 60 or other container, while minimizing exposure to the exterior environment.

In the exemplary embodiments illustrated in the Figures, latches 28 engage corresponding recesses 30, formed in the outer surface of housing 14, however, it should be understood that any suitable means for releasably securing and locking door 18 may be utilized. As shown, an annular thermal seal 15 may be secured to the upper edges of both the door 18 and the housing 14. Annular seal 15 may be formed from rubber or any other suitable flexible and thermally insulative material. Seal 15 further acts to support and secure keg 26, when the keg 26 is received within housing 14.

Figure 2:
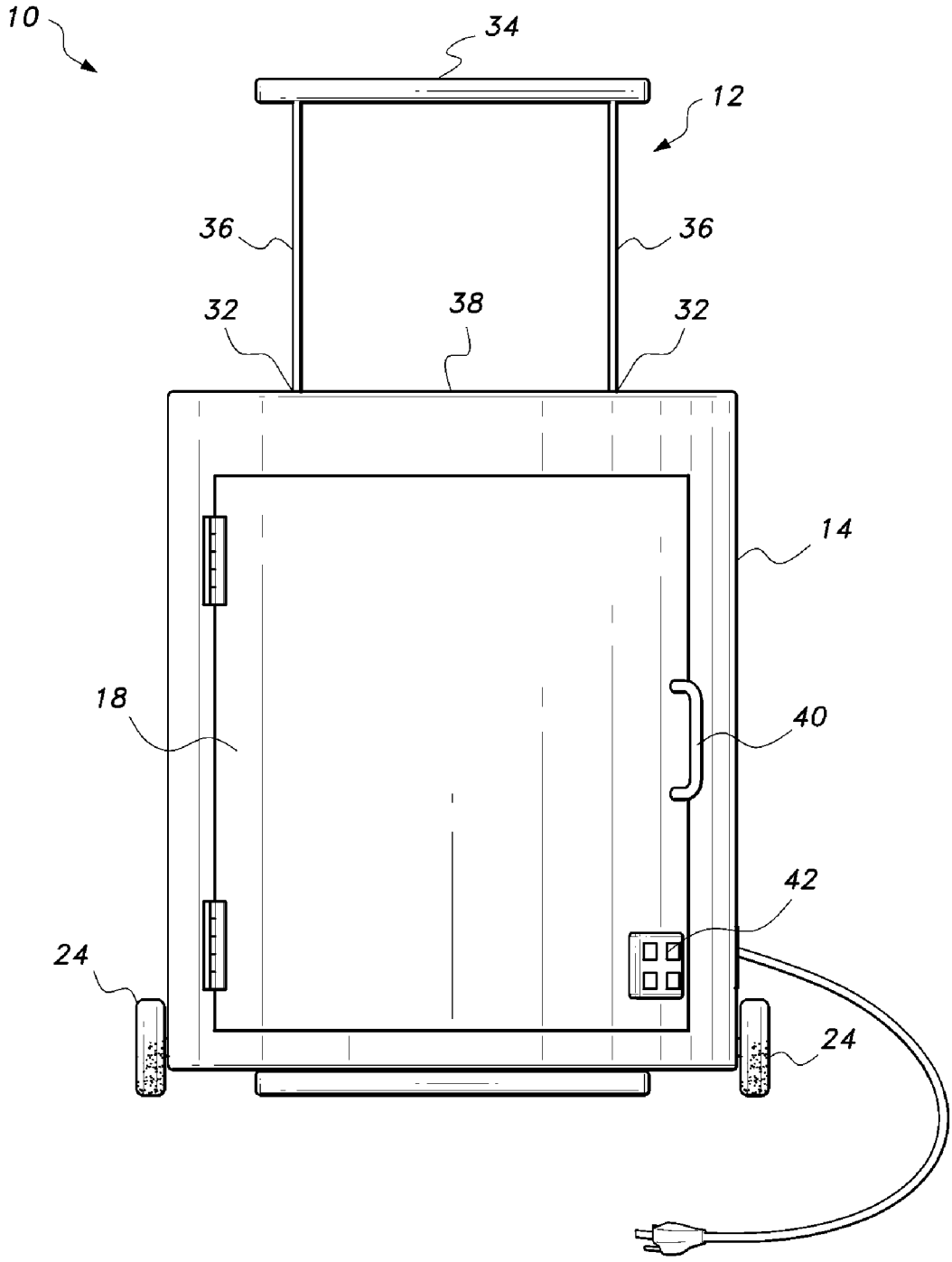
FIG. 2 is a front view of the portable cooler according to the present invention.

As best shown in FIG. 2, a door handle 40 may be mounted to the door 18, providing the user with a gripping device for easily opening and closing the door 18. Further, a control panel 42 may be mounted to door 18, as shown, providing the user with selective control over the temperature and operation of the refrigeration system (to be described in greater detail below). Control panel 42 may alternatively be mounted to any suitable portion of housing 14.

Figure 5:
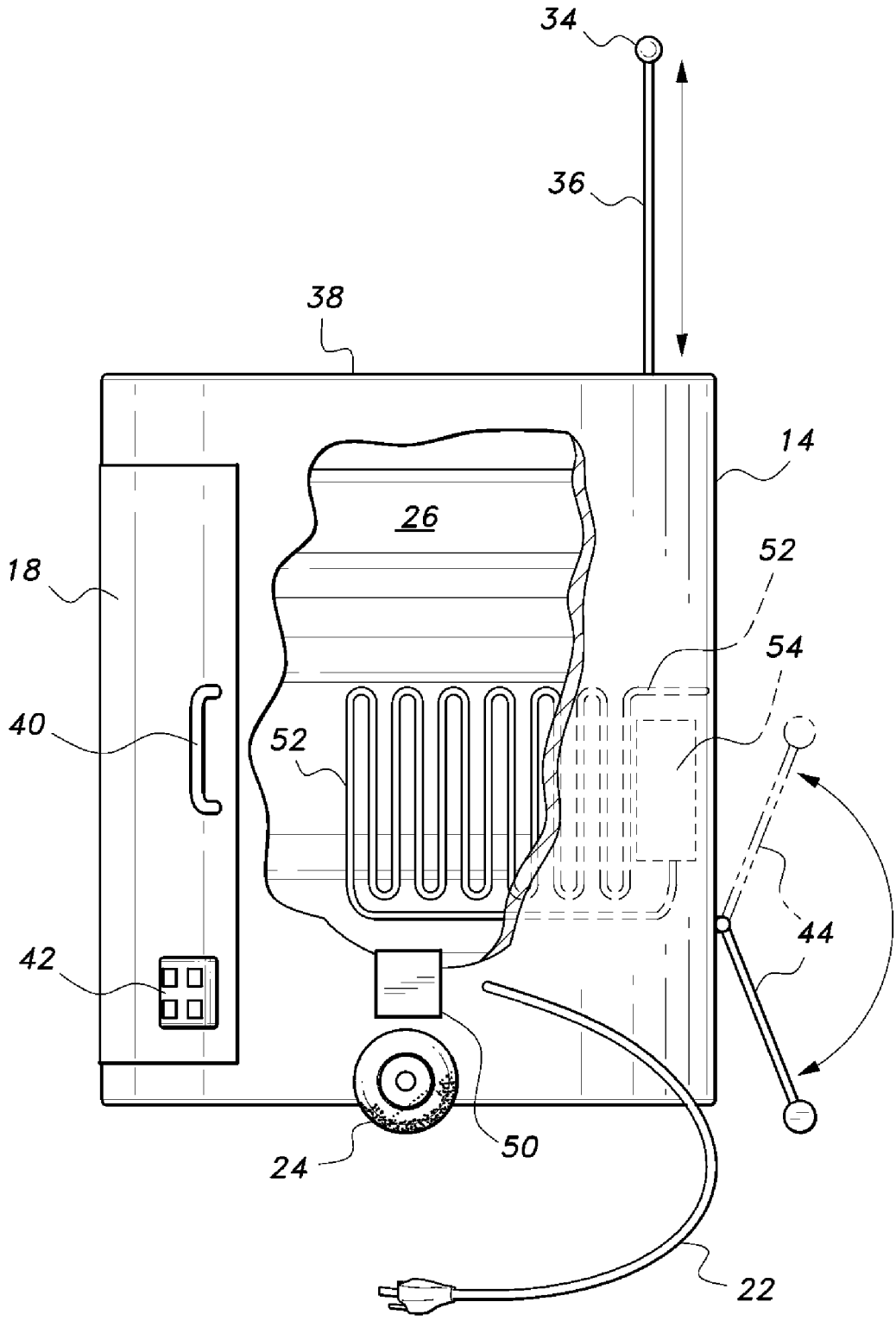
FIG. 5 is a side, partial cut-away view of the portable cooler according to the present invention.

As shown in FIG. 5, a refrigeration system is mounted within the housing 14, adjacent the keg 26, for selective and controlled cooling thereof. The refrigeration system may be powered by an external power source, such as a standard household AC electrical source, via power cord 22 (shown in FIG. 1), or may alternately be powered by batteries 50, which may be rechargeable, also received within the housing 14. In one embodiment, the refrigeration system may be adapted to run on a gasoline, diesel or other engine, such as a portable generator or a motor vehicle engine. Conveniently, power cord 22 may be adapted to include a plug 23 that is sized and shaped to be received in a cigarette lighter receptacle of the motor vehicle to electrically connect the refrigeration system to a power source of the motor vehicle via the cigarette lighter receptacle as shown in the alternative embodiment illustrated in FIG. 6.

In yet another embodiment of the invention, the refrigeration system is electrically connected to a solar power unit, which may be a portable solar powered unit. The solar power unit will typically comprise at least one solar cell or photovoltaic panel which receives light from an external source such as the sun. The electrical power generated by the one or more solar cells is provided to a power storage block, which may include one or more batteries or other power storage device(s). A controller and/or inverter block may be coupled to the power storage block. The controller and/or inverter block may include an inverter to convert the power received from the power storage block to an appropriate power signal for the refrigeration unit. Optionally, the photovoltaic units may be selectively positionable at a plurality of angles in order to optimally receive sunlight. In one embodiment, the solar powered unit or photovoltaic panel thereof, is adapted for mounting on the roof of a motor vehicle. According to this embodiment, the positioning of the photovoltaic panels may be optionally adjustable by any suitable means, such as mechanical, hydraulic, electronic or the like. In another aspect of this embodiment, the photovoltaic panels are mounted in a fixed position, but can be positioned to receive sunlight by manually moving the photovoltaic unit itself or, e.g., moving the motor vehicle upon which the photovoltaic panels are mounted.

The refrigeration system may be a conventional refrigeration system, including a fan 56 one or more refrigeration coils 52, such as condenser coil 55, in communication with a compressor motor 54, or the like. As used herein, terms "refrigeration system" and "refrigeration device" are interchangeable. It should be understood that refrigeration coils 52 and compressor motor 54 are shown for exemplary purposes only, and that any suitable user-controllable and actuatable refrigeration system may be utilized. In certain embodiments, the refrigeration system is a compact and/or lightweight unit suitably sized to fit within or about the housing 14, including but not limited to high efficiency refrigeration systems. Optionally, one or more components of the refrigeration system (e.g., the refrigeration coils 52) may be mounted on the exterior of the cooler. As noted above, control panel 42 is mounted on the housing 14, with the control panel 42 being in communication with the refrigeration system, allowing the user to selectively and adjustably control the temperature within the housing 14.

A plurality of wheels 24 are pivotally mounted to a lower end of the housing 14, allowing the housing 14 to be transported to any desired location. Though shown as having two such wheels 24 in the Figures, it should be understood that this is for exemplary purposes only, and any desired number of wheels may be pivotally mounted to the lower end of housing 14. Additionally, a handle 12 is mounted to an upper end of the housing 14, providing the user with a grip for the transport of the housing 14 and container 26 in a controlled manner. The handle 12 is preferably retractable within the housing 14, and is positioned in the vertical direction (as indicated by the directional arrow in FIG. 5). As best shown in FIG. 2, handle 12 preferably includes a pair of side supports 36, and a central gripping member 34. In certain embodiments, a second, optionally retractable handle is mounted to a lower end of the housing to facilitate lifting the portable cooler using two hands or by two persons. In one aspect of the invention, the first and second handles are mounted to the rear of the housing. In certain embodiments, the lower handle may also serve as a foot-actuated titling device for titling the cooler 10 relative to the support surface during transport. The skilled artisan will appreciate that certain embodiments of the cooler may more easily wheeled in a tilted position similar to the operation of a hand truck. In certain other embodiments, the cooler may have a separate foot-actuated titling means attached to the lower portion of the cooler 10, such as on the rear face or bottom of the housing 14, below handle 12 and positioned at a height suitable for titling the cooler using foot action while grasping handle 12.

Figure 3:
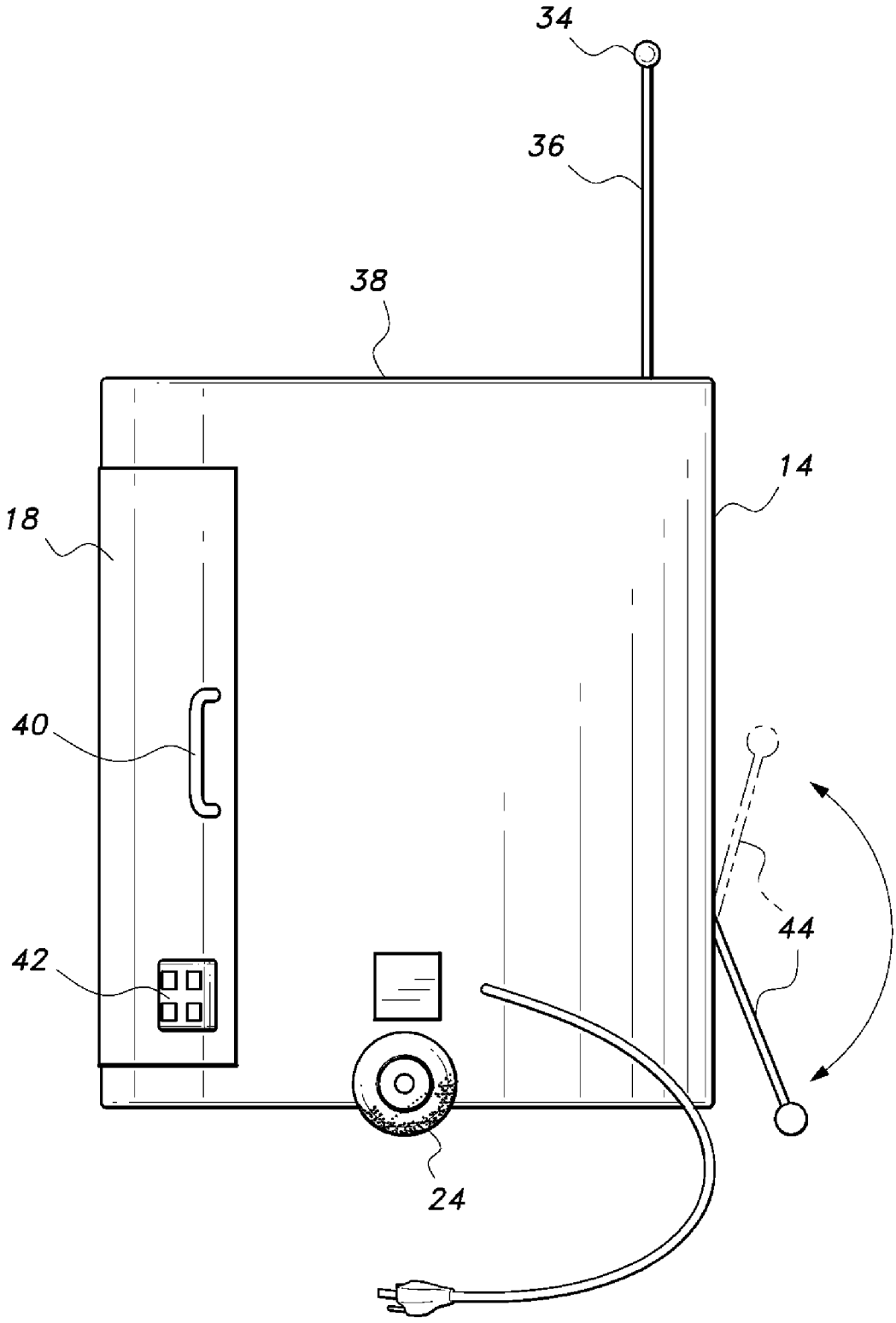
FIG. 3 is a side view of the portable cooler according to the present invention.
Figure 4:
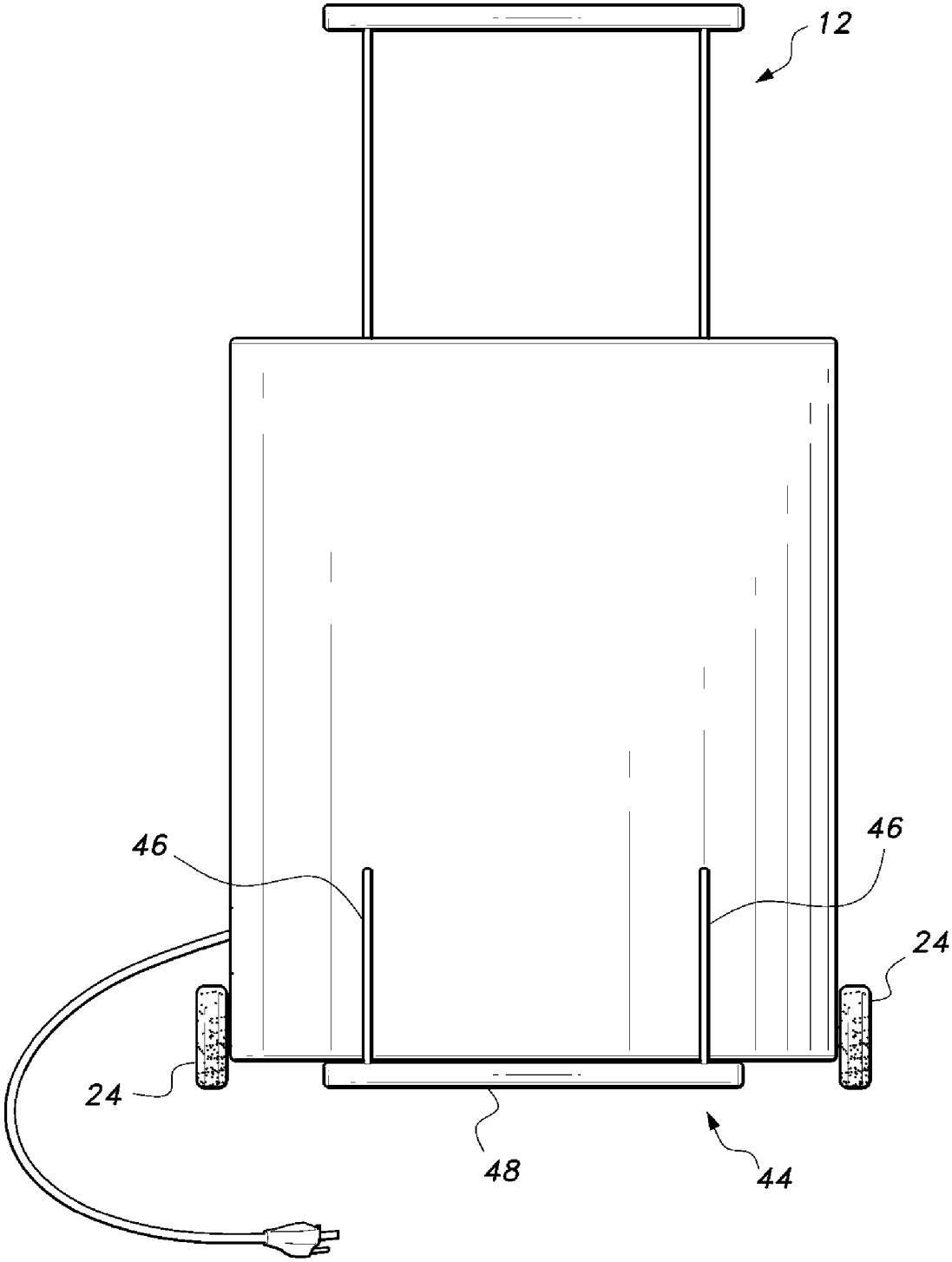
FIG. 4 is a rear view of the portable cooler according to the present invention.

Further, as shown in FIGS. 3 and 4, a support stand 44 may be pivotally mounted to a rear face of the housing 14, allowing the housing 14 to be supported at an angle with respect to a support surface, such as the floor or the ground. Support stand 44 may include a pair of side support members 46 that support a crossbar 48. A proximal end of each side support member 46 can be pivotally joined to the rear face of housing 14, by hinges or the like, with the distal ends of side support members 46 being secured to opposite ends of crossbar 48. Additionally, a pair of upper supports 13 may be mounted to the rear face of housing 14, allowing the cooler 10 to be positioned horizontally on a support surface, such as the ground or floor. Supports 13 cooperate with support stand 44 which, in its deployed position, allows for either the horizontal or angled positioning of the cooler 10 with respect to the horizontal. Alternatively, wheels 24 may be positioned towards the rear of housing 14, allowing supports 13 to act cooperatively with the wheels 24 for the horizontal positioning of the cooler 10.

In use, the user releases latches 28 and opens door 18 or doors 19 to provide access to the open interior region 16. A keg 26 or other suitable container is received within the open interior region 16 and the user closes door 18 and re-secures latches 28, to secure the keg 26 within housing 14. Housing 14 may be formed, at least partially, from a thermally insulating material. The user may input a desired temperature or other operational parameters into control panel 42, for the controlled and selective actuation of the refrigeration system.

The user may further deploy handle 12 and, used in combination with wheels 24, transport the housing 14 and keg 26 to a desired location. Support stand 44 may further be deployed if the user wishes to support the housing 14 at an angle with respect to the support surface. The handle 12 and support stand 44 may both be selectively retracted for storage of the portable cooler 10.

In one embodiment of the invention, the portable cooler may be adapted for carbonated drink dispensing. According to this embodiment, as shown in FIG. 6, interior region 16 is sized to receive the components of a carbonated beverage system 60, such as a soft drink mixing and/or dispensing system. The system may comprise one or more of a pressurized $CO_2$ cylinder 62, a carbonating vessel 64, syrup reservoir 66, and dispensing port 61, which may be connected through a series of tubes 68. Flow through the system may be delivered via one or more in-line mechanical pumps. Optionally, the system may include a trigger-operated delivery gun, which may be adapted to dispense one of several available beverage flavors from a plurality of syrup reserviors. In certain aspects of the invention, the $CO_2$ cylinder component of the carbonated beverage system may be located on the exterior of housing 14 in a compartment 72 adapted to removably receive and secure the cylinder. According to this embodiment, communication between the $CO_2$ cylinder and the interior of the compartment may provided by an opening in the housing 14.

It is to be understood that the present invention is not limited to the embodiments described above, but encompasses any and all embodiments within the scope of the following claims

I claim:

1. A portable cooler for cooling large keg-sized removable containers, comprising:

a housing having an opening formed through a front face thereof, said housing defining an open interior region adapted for removably receiving a removable container;

a door pivotally mounted to said housing, said door selectively sealing and covering the opening formed through the front face of said housing;

an electrically powered refrigeration device received within said housing for selectively and adjustably cooling a container received adjacent to the device within the interior region;

a plurality of wheels being pivotally mounted to a lower end of said housing;

a retractable handle being mounted to an upper end of said housing, wherein the cooler and any received containers may be selectively and guidedly transported via the wheels after tilting the housing relative to the support surface; and a rechargeable battery adapted to power the refrigeration device.

2. The portable cooler as recited in claim 1, further comprising a support stand mounted to a rear face of said housing.

3. The portable cooler as recited in claim 1, wherein the housing is cylindrical and open so that a received container projects upwardly therethrough with only its top exposed.

4. The portable cooler as recited in claim 1, wherein the container is a beer keg or a carbonated beverage system.

5. The portable cooler as recited in claim 1, wherein the housing comprises plastic, steel or aluminum and features a second handle pivotably mounted to the bottom of the housing so that the second handle may be a support stand or a handle for carrying the cooler.

6. The portable cooler as recited in claim 1, further comprising means for electrically connecting the refrigeration device to a motor vehicle cigarette lighter.

7. The portable cooler as recited in claim 1, further comprising means for electrically connecting the refrigeration device to a solar power unit.

8. The portable cooler as recited in claim 7, wherein the solar power unit comprises at least one solar cell or photovoltaic panel and a power storage block.

9. The portable cooler as recited in claim 1, wherein the housing is cylindrical.

10. A portable cooler for cooling large keg-sized removable containers, comprising:

a housing having an opening formed through a front face thereof, said housing defining an open interior region adapted for removably receiving a removable container;

a pair of doors, each pivotally mounted to said housing, said pair of doors selectively sealing and covering the opening formed through the front face of said housing;

an electrically powered refrigeration device received within said housing for selectively and adjustably cooling a container received adjacent to the device within the interior region;

a plurality of wheels being pivotally mounted to a lower end of said housing;

a handle being mounted to an upper end of said housing, wherein the cooler and any received containers may be selectively and guidedly transported via the wheels after tilting the housing relative to the support surface; and a rechargeable battery adapted to power the refrigeration device.

11. The portable cooler as recited in claim 10, wherein the housing is cylindrical and open so that a received container projects upwardly therethrough.

12. The portable cooler as in claim 1, wherein said rechargeable battery is received within said housing.

13. The portable cooler as in claim 10, wherein said rechargeable battery is received within said housing.

14. The portable cooler as in claim 1, wherein the weight of said removable container is 100 pounds or more.

15. The portable cooler as in claim 10, wherein the weight of said removable container is 100 pounds or more.

16. The portable cooler as recited in claim 10, further comprising a support stand mounted to a rear face of said housing.

17. The portable cooler as recited in claim 10, further comprising means for selectively and releasably locking said door to said housing.

18. The portable cooler as recited in claim 10, wherein the container is a beer keg or a carbonated beverage system.

19. The portable cooler as recited in claim 10, wherein the housing comprises plastic, steel or aluminum.

20. The portable cooler as recited in claim 10, further comprising means for electrically connecting the refrigeration device to a motor vehicle cigarette lighter.

21. The portable cooler as recited in claim 10, further comprising means for electrically connecting the refrigeration device to a solar power unit.

22. The portable cooler as recited in claim 21, wherein the solar power unit comprises at least one solar cell or photovoltaic panel and a power storage block.

23. A portable cooler for cooling large keg-sized removable containers, comprising:

a cylindrical housing having an opening formed through a front face thereof, said housing defining an open interior region adapted for removably receiving a removable container;

at least one door pivotally mounted to said housing, said door selectively sealing and covering the opening formed through the front face of said housing;

an electrically powered refrigeration device received within said housing for selectively and adjustably cooling the removable container received within the interior region adjacent to the device;

a plurality of wheels being rotatably mounted to a lower end of said housing;

a retractable handle being mounted to an upper end of said housing, wherein the housing may be tilted with respect to the support surface and guidedly transported via the wheels, and a rechargeable battery adapted to power the refrigeration device, wherein said removable container is a removable beer keg.

24. The portable cooler as in claim 23, wherein said removable beer keg weighs over 100 pounds.

* * * * *